US006145458A

United States Patent [19]

Hattori

[11] Patent Number: 6,145,458

[45] Date of Patent: Nov. 14, 2000

[54] REAR SEAT AND SUPPORT FOR WATERCRAFT

[75] Inventor: Toshiyuki Hattori, Iwata, Japan

[73] Assignee: Yamaha Hatsudoki Kabushiki Kaisha, Iwata, Japan

[21] Appl. No.: 09/210,420

[22] Filed: Dec. 11, 1998

[51] Int. Cl.[7] ..... B63B 35/73

[52] U.S. Cl. ..... 114/55.57

[58] Field of Search ..... 114/363, 55.5, 114/55.53, 55.57

[56] References Cited

U.S. PATENT DOCUMENTS

| | | | |
|---|---|---|---|
| 4,318,700 | 3/1982 | Price . | |
| 4,673,212 | 6/1987 | Mayer . | |
| 4,688,509 | 8/1987 | Nishida . | |
| 5,218,922 | 6/1993 | Kobayashi . | |
| 5,309,861 | 5/1994 | Mardikian | 114/363 |
| 5,320,059 | 6/1994 | Ikeda . | |
| 5,406,904 | 4/1995 | Kobayashi . | |
| 5,537,948 | 7/1996 | Kobayashi . | |
| 5,584,733 | 12/1996 | Kobayashi . | |
| 5,586,922 | 12/1996 | Kobayashi et al. . | |
| 5,607,332 | 3/1997 | Kobayashi et al. . | |
| 5,676,066 | 10/1997 | Watkins . | |
| 5,676,086 | 10/1997 | Watkins . | |
| 5,676,096 | 10/1997 | Nishi et al. . | |
| 5,794,556 | 8/1998 | Kobayashi . | |
| 5,915,329 | 6/1999 | Watkins et al. . | |
| 5,964,172 | 10/1999 | Ikeda . | |

FOREIGN PATENT DOCUMENTS

| | | |
|---|---|---|
| 62-55288 | 3/1987 | Japan . |

*Primary Examiner*—Stephen Avila

*Attorney, Agent, or Firm*—Knobbe, Martens, Olson, and Bear LLP

[57] ABSTRACT

An improved seat design for a small watercraft increases the ability of a rider on the watercraft to monitor activities taking place behind the watercraft. The watercraft includes a contoured rear seat that is wider than the front seat. The wider surface area provides riders with the ability to quickly turn and look behind the watercraft. The rear seat also includes several handles or grips to provide added stability to a watercraft rider.

34 Claims, 16 Drawing Sheets

REAR SEAT AND SUPPORT FOR WATERCRAFT

BACKGROUND OF THE INVENTION

1. Field of the Invention

The present invention relates in general to a watercraft seat, and more particularly, to an improved rear seat and support for use on a watercraft.

2. Description of the Related Art

Watercraft, especially those known as personal watercraft, have become popular in recent years. This type of watercraft is sporting in nature; it turns swiftly, is easily maneuvered, and accelerates quickly. A personal watercraft today commonly carries one rider and one, two or possibly three passengers. For this purpose, watercraft typically have an elongated seat on which the passengers sit and straddle in a tandem fashion.

Personal watercraft continue to evolve and grow in size. While originally designed for the recreational use of a single rider, personal watercraft have increased in size and power. These watercraft are currently used in many diverse areas other than personal recreation such as lifeguard rescue, public safety and military uses, among others. The predominant use of these watercraft, however, remains recreational, and these new personal watercraft now provide more recreational possibilities than ever before.

Personal watercraft have now become powerful enough to tow water skiers. Common sense, as well as various laws and regulations, though, dictate that all water skiing tow vehicles must carry at least two persons: one who is operating the towing vehicle, and one who maintains a constant watch on the water skier. This allows the operator of the watercraft to maintain an adequate lookout to ensure safe operation of the watercraft, while simultaneously allowing another rider to closely observe the water skier to ensure the safety of the skier.

Prior personal watercraft, however, have not provided a seat conducive to observing easily the water skier behind the watercraft. The riding passenger must swing their body or turn around while riding to properly monitor the recreational activity. Typically, a relatively small rear seat on the watercraft does not provide room for a passenger to be seated comfortably and safely while maintaining a generally forwardly facing position and monitoring the activities behind the watercraft.

Conventionally, a riding passenger on the watercraft maintains stability through the use of hand grips located at the base of the rearward seat section. Typically, these hand grips are located along the rear or side of the seat base, below the rider's seating area. A riding passenger who is monitoring recreational activities occurring off the rear of the watercraft, often both straddle and hold onto the hand grips in an awkward position.

SUMMARY OF THE INVENTION

A need exists for an improved seat assembly with a rear seat and support designed for a watercraft passenger to observe a water skier behind the watercraft.

In accordance with one aspect of the present invention, a watercraft is provided with an improved seat design for carrying a plurality of passengers on the watercraft. The seat comprises a forward seat section located toward the bow of the watercraft and a seat section located toward the stem of the watercraft. In one mode, the rear seat section comprises a large seating area surrounded by a raised passenger support. The support extends around the perimeter of the rear passenger seat thereby providing maximum comfort and safety. The rearward seat section is of a width sufficiently greater than the forward seat section for increased riding comfort and stability.

In accordance with another aspect of the present invention, a watercraft is provided with an improved seat design and support with passenger hand grips. The hand grips are properly located to allow a watercraft passenger to maneuver quickly and safely when monitoring activities occurring at the rear of the watercraft.

In accordance with an additional aspect of the present invention, an improved watercraft and seat design is provided for carrying larger items in the watercraft. The watercraft comprises a rearward seat section defining a storage compartment. The storage compartment is located below the rear seat where the riding passenger is seated. The rearward seat section is of greater width than the forward seat section, thus defining a larger storage compartment on the watercraft. This location maximizes the limited space on the watercraft while providing storage space for bulkier recreational equipment.

Another aspect of the present invention involves a watercraft comprising a hull having a lower hull portion and an upper deck portion. A propulsion system is carried by the hull to propel the watercraft. The upper deck portion includes a central elongated seat assembly having a front seat section and a rear seat section. The seat sections are positioned about a longitudinal axis. The rear seat section has a width, as measured in a direction generally normal to the longitudinal axis, that is greater than a width of the front seat section. The seat assembly also includes at least one handle positioned next to the rear seat section.

Further aspects, features and advantages of the present invention will become apparent from the detailed descriptions of the preferred embodiments which follows.

BRIEF DESCRIPTION OF THE DRAWINGS

The above-mentioned and other features of the invention will now be described with reference to the drawings of preferred embodiments of the present watercraft. The illustrated embodiments are intended to illustrate, but not to limit the invention, and contain the following figures.

DETAILED DESCRIPTION OF THE PREFERRED EMBODIMENTS OF THE INVENTION

Figure 1:
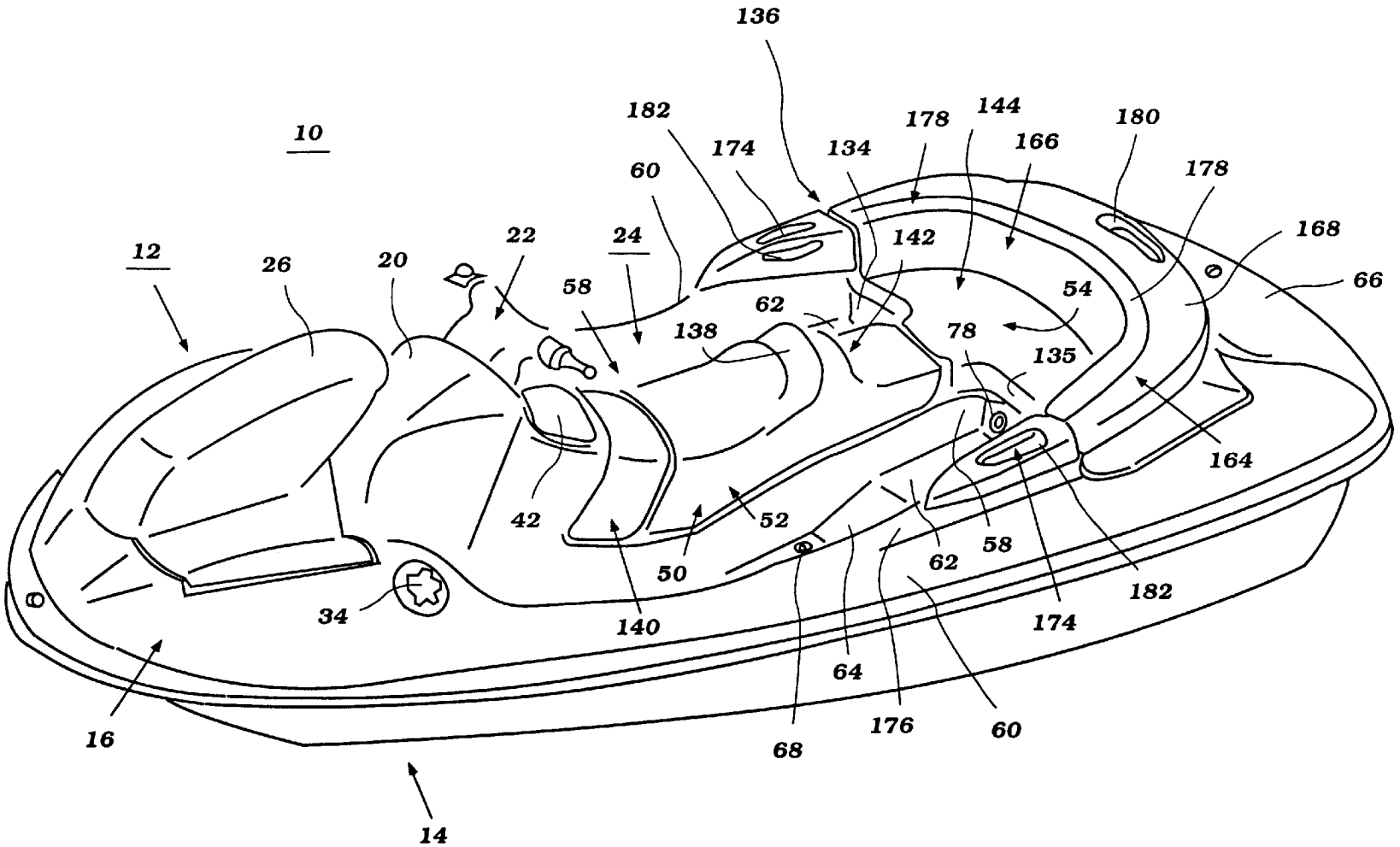
FIG. 1 is a perspective view of a watercraft including a seat assembly configured in accordance with a preferred embodiment of the present invention.

Several embodiments of an improved seat assembly are disclosed herein. Each of these embodiments employ the same basic concept characteristic of the improved seat assembly, namely a large rear seating area surrounded by a raised support. In some modes, hand grips are provided about the seating area to assist the rider in shifting his or her position on the seat into a comfortable position when looking backwards, as well as when seated in a forward-facing position. In some modes, the rear seat can be raised to gain access into a storage compartment located beneath the seat. It will be understood, however, that these and various other aspects of the embodiments described below can be present individually or in combination in a watercraft. In addition, like reference numerals have been used with each embodiment to identify common components. Thus, unless otherwise indicated, the following description of common components should apply equally to all embodiments.

The present seat assembly has particular utility with personal watercraft, and thus, the following describes the seat assembly in the context of a personal watercraft. This vehicle is merely exemplary though. The present seat assembly can be adapted for use with other types of vehicles as well, such as, for example, but without limitation, small jet boats and the like.

FIGS. 1–10 illustrate a personal watercraft incorporating an improved rear seat and support configured in accordance with a preferred embodiment of the present invention. The watercraft 10 includes a hull 12 formed by a lower hull section 14 and an upper deck section 16. These hull sections 14, 16 are formed of a suitable material such as, for example, a molded fiberglass reinforced resin or SMC. The lower hull section 14 and the upper deck section 16 can be fixed to one another around the peripheral edges 18 in any suitable manner commonly known to those skilled in the art.

As viewed in the direction from the bow to the stem of the watercraft (i.e., in a longitudinal direction), the upper deck section 16 includes a bow portion 20, a control mast 22 and a rider's area 24. The bow portion 20 serves as a base for the control mast 22 and slopes upwardly toward the control mast.

Figure 4:
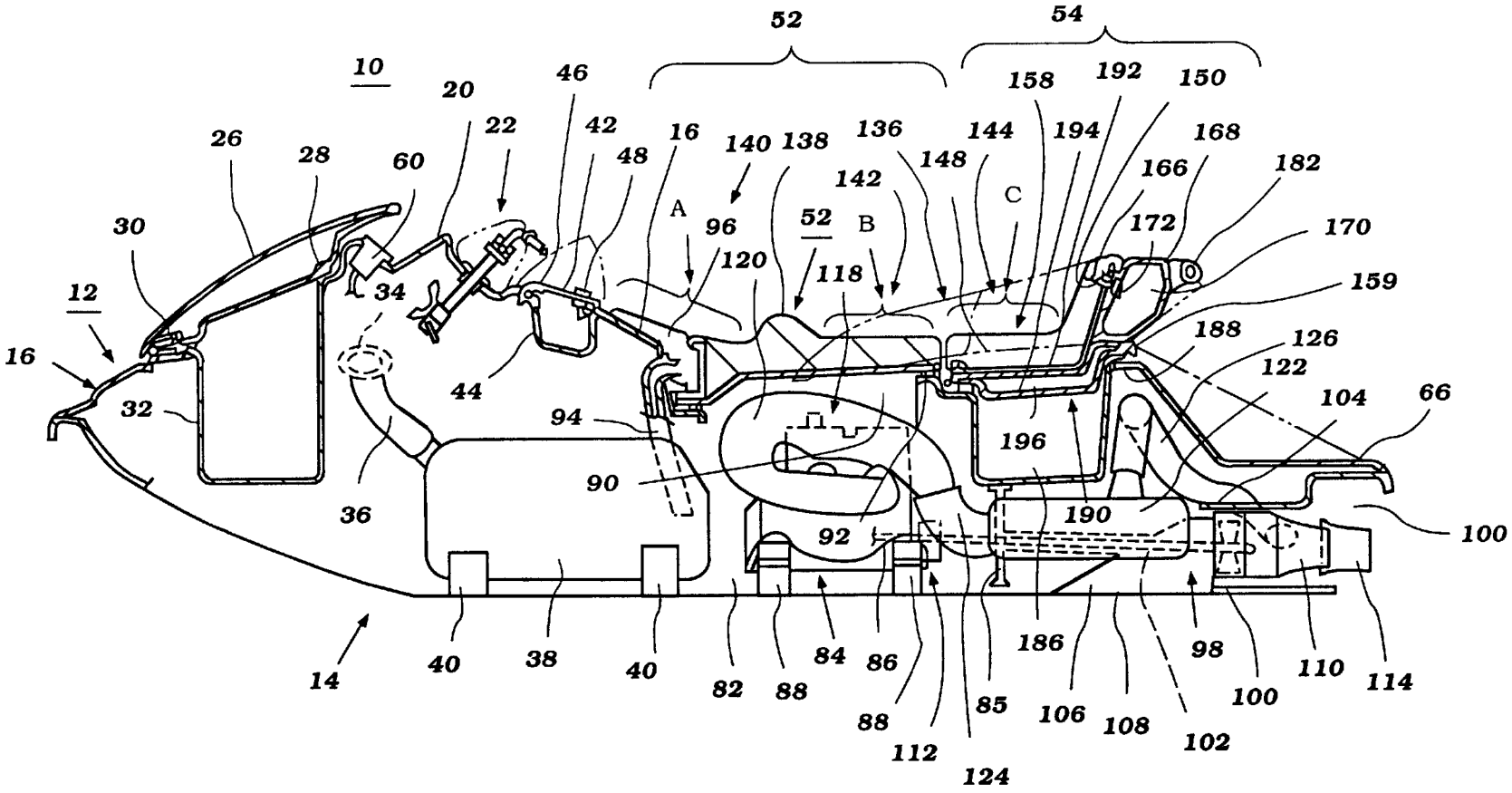
FIG. 4 is a sectional side view of the watercraft of FIG. 1, illustrating several internal components of the watercraft.

As illustrated in FIGS. 1 and 4, a hatch cover 26 is provided in front of the control mast 22 that desirably extends above the bow portion 20 of the upper deck 16. The hatch cover 26 is able to open and close freely, thereby exposing the forward section of the interior of the hull 14. The hatch cover 26 defines a generally smooth outer surface and is shaped to cooperate with the remainder of the upper deck 16, so that the bow of the watercraft presents an aerodynamic design. A latch 28 is provided to secure the hatch cover 26 in its closed position during the operation of the watercraft 10.

The hatch cover 26 can be attached to the upper deck 18 by a hinge 30. Various other mechanisms well known by those skilled in the art, such as latches, snap fasteners, and/or straps, among others can also be used to attach the hatch cover 26 to the upper deck 18. A storage box 32 is removably provided in the deck below the hatch cover 26. This storage box 32 is covered by the hatch cover 26 in a water sealing manner.

As illustrated in FIGS. 1 and 4, a fuel supply port defined in the bow portion 20 of the upper deck 16 is covered by a filler cap assembly 34. A fuel filler hose 36 extends from the surface of the upper deck 16 to the fuel tank 38. As illustrated, the fuel tank 38 is secured to the lower hull 14 through damper members or mounts 40. Other conventional means such as straps can also be used to secure the fuel tank to the lower hull 14. As illustrated, the fuel tank 38 can be filled from outside the hull 14 with the fuel passing through the fuel filler hose 36 into the fuel tank 38.

Figure 2:
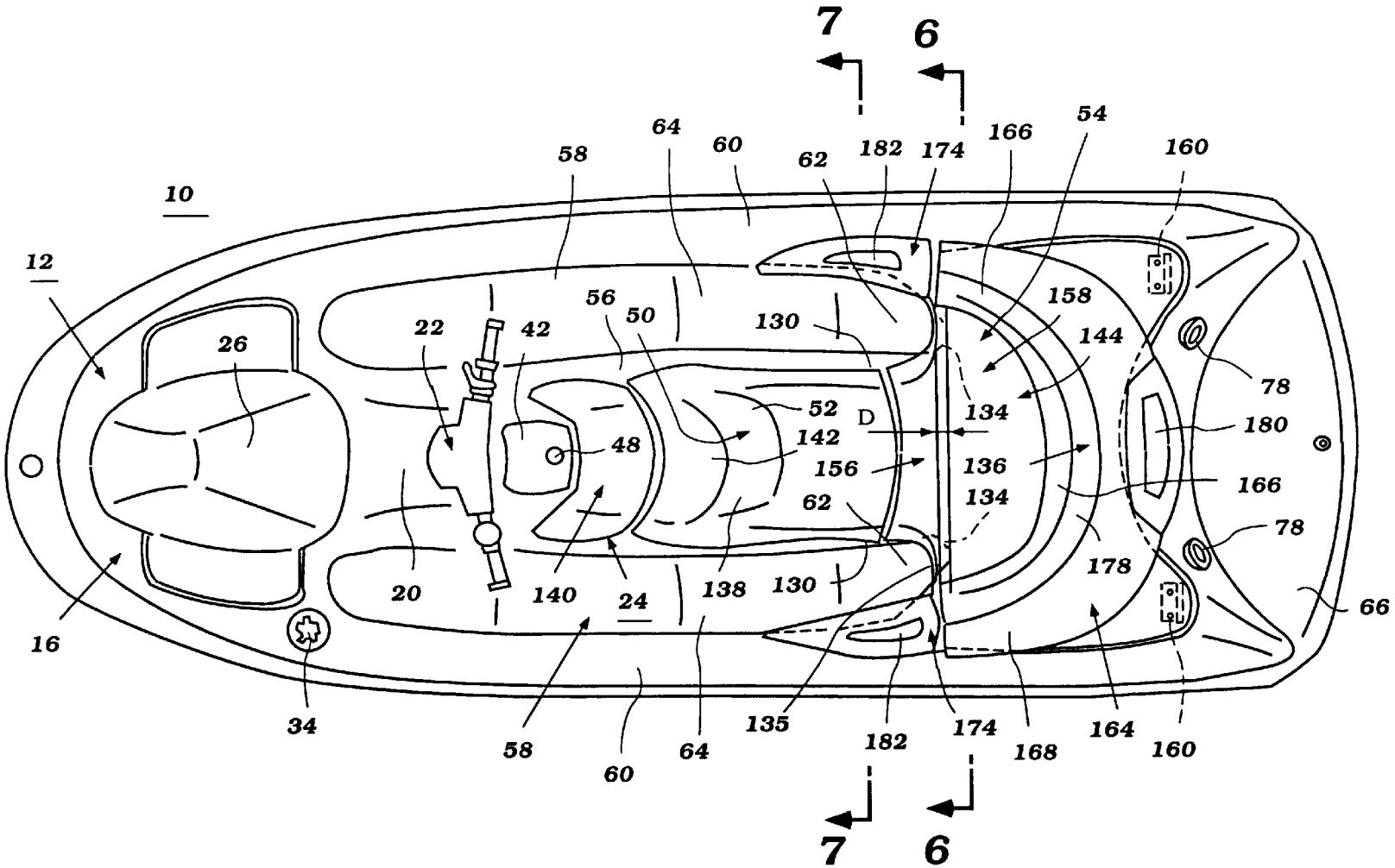
FIG. 2 is a top plan view of the watercraft of FIG. 1.

As illustrated in FIGS. 1, 2 and 4, a small storage compartment cover 42 is provided in the area generally behind of the control mast 22 in the rider's area 24. The cover 42 is able to open and close freely, thereby exposing a compartment 44. For this purpose, a hinge 46 attaches the cover 42 to the hull 12. Various other mechanisms well known by those skilled in the art, such as latches, snap fasteners, and/or straps, among others can also be used to attach the cover 42 to the upper deck 18. A key operated latch 48 is provided to secure the cover 42 in its closed position during the operation of the watercraft 10.

The compartment or storage box 44 can be removably provided in the area below the cover 42; however, in the illustrated embodiment, the storage compartment 44 is integrally formed with the surrounding upper deck structure. The compartment 44 provides a locking storage area for smaller articles such as, for example, sunglasses, keys, and riding gloves. This storage box 44 is covered by the cover 42 in a water sealing manner.

A seat assembly 50, which will be described in detail below, is provided in the rider's area 24. The seat assembly 50 is configured in accordance with a preferred embodiment of the present invention and is a straddle-type seat having an elongated shape and extending about the longitudinal axis of the watercraft 10. In the illustrated embodiment, the seat assembly 50 is divided into front and rear sections 52, 54 which are attached to a longitudinally extending pedestal 56. The pedestal 56 desirably is formed as part of the upper deck 16. Thus, the seat assembly 50 and the pedestal 56 are centrally located between the sides of the hull 12.

As best seen in FIGS. 1, 2, 5, 7 and 10, the upper deck 16 also includes a foot area or foot well 58 formed along each side of the pedestal 56. The foot areas 58 are formed between the pedestal 56 and a pair of raised side bulwarks 60 that extend along the outer sides of the watercraft in the rider's area 24. The foot areas 58 are sized to accommodate the legs and feet of riders who straddle the seat assembly 50. In the illustrated embodiment, each foot area 58 in the upper deck 16 further includes an elevated foot area 62 marked by an incline or step 64 along the base of the pedestal 56. As illustrated in FIG. 2, the elevated foot area 62 is located to the sides of the pedestal 56 below a front edge of the rear seat section 54.

The upper deck section 16 further includes a rear deck section 66 located at the stern of the watercraft 10. The rear deck 66 allows easy entry into the watercraft 10, as known in the art.

Figure 3:
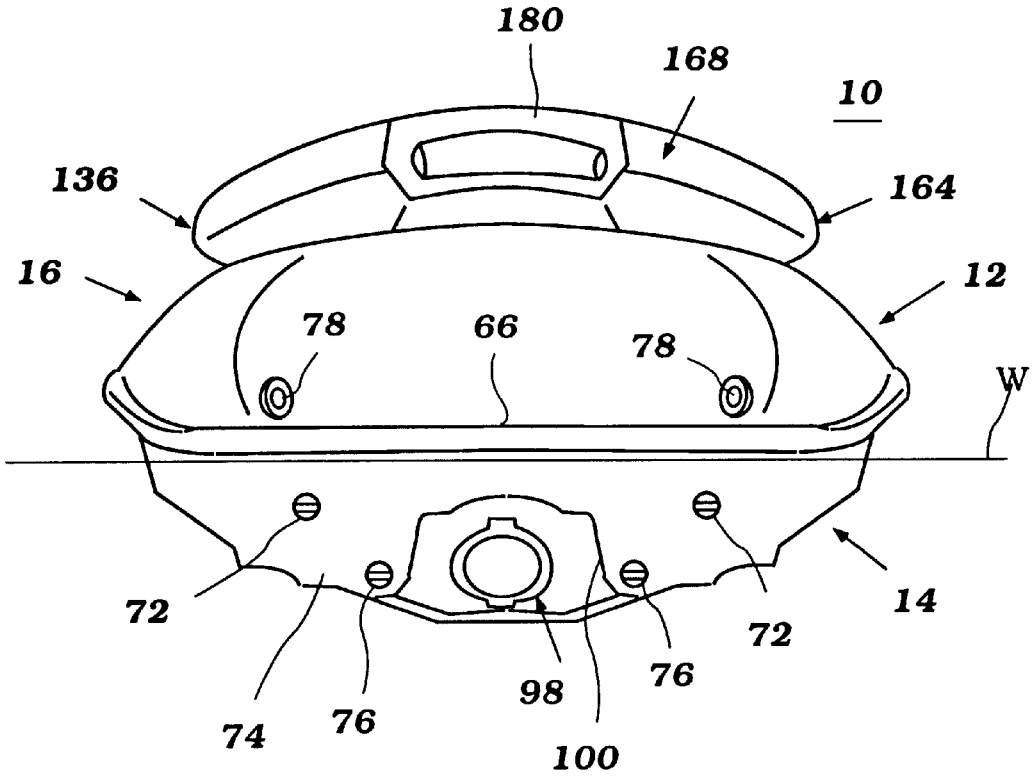
FIG. 3 is a rear side elevational view of the watercraft of FIG. 1.
Figure 5:
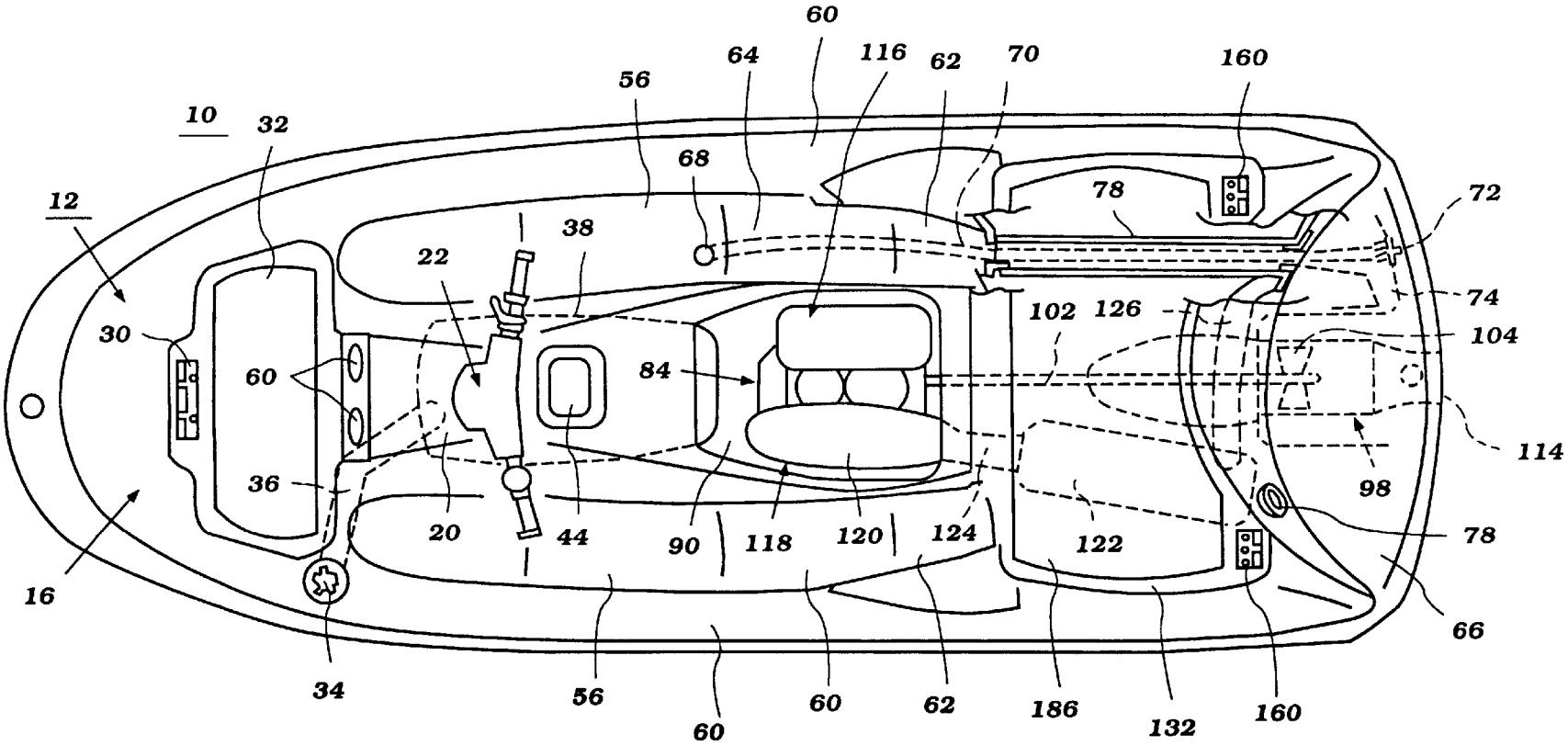
FIG. 5 is a top plan view with the seat assembly and a front hatch assembly removed.

As illustrated by FIGS. 1, 3 and 5, the hull 12 further comprises a drain hole and plug 68 located in each foot well 58 of the upper deck 16. Each drain hole 68 connects through a downwardly inclined conduit 70 in the hull 12 to another drainage hole and plug 72 located on the transom 74 of the watercraft 10. (Although FIG. 5 depicts only one of the drain hole and plug assembly and corresponding conduit 70 in phantom, such a drainage system communicates with both foot wells 58, as stated above.) This drainage system allows water collected in the respective foot area 58 to be purged when the watercraft is raised out of the water. It is also understood that these drainage systems can merge and discharge through a single port on the transom.

Additionally, another set of drain plugs 76, which are located on the transom 74 of the watercraft 10, serve to drain water present within the hull 12. When the watercraft is raised out of the water, the drain plugs 76 can be removed to drain the water from the bilge area in the hull 12. In the illustrated embodiment, the drainage holes 72, 76 on the transom 74 are located below the water line W during normal operation of the watercraft 10 with the corresponding plugs sealing the holes.

As further illustrated in FIGS. 1, 3 and 5, the hull 12 also includes a drain passage 78 located near the foot area 58 under a rear seat section 54 located near the stem of the watercraft 10. This drain passage 78 extends through to the transom 74 of the watercraft 10. The drain passage 78 allows water located in the foot area 58 to drain from the foot wells 58 when the watercraft 10 is up on plane.

FIGS. 4 and 5 illustrate a display panel 80 of the watercraft 10 in accordance with the present invention. As best illustrated in FIG. 4, the display panel 80 is mounted to the bow portion 20 of the upper deck 16 of the watercraft 10, generally forward of the control mast 22, but rear of the hatch 26. The display panel provides information, in various modes, to the watercraft rider. Preferably, the display panel 80 includes displays for engine speed (rpm) in graphical form and watercraft velocity in numerical form. The display panel 80 also can provide other information as well, as known by those skilled in the art.

Figure 7:
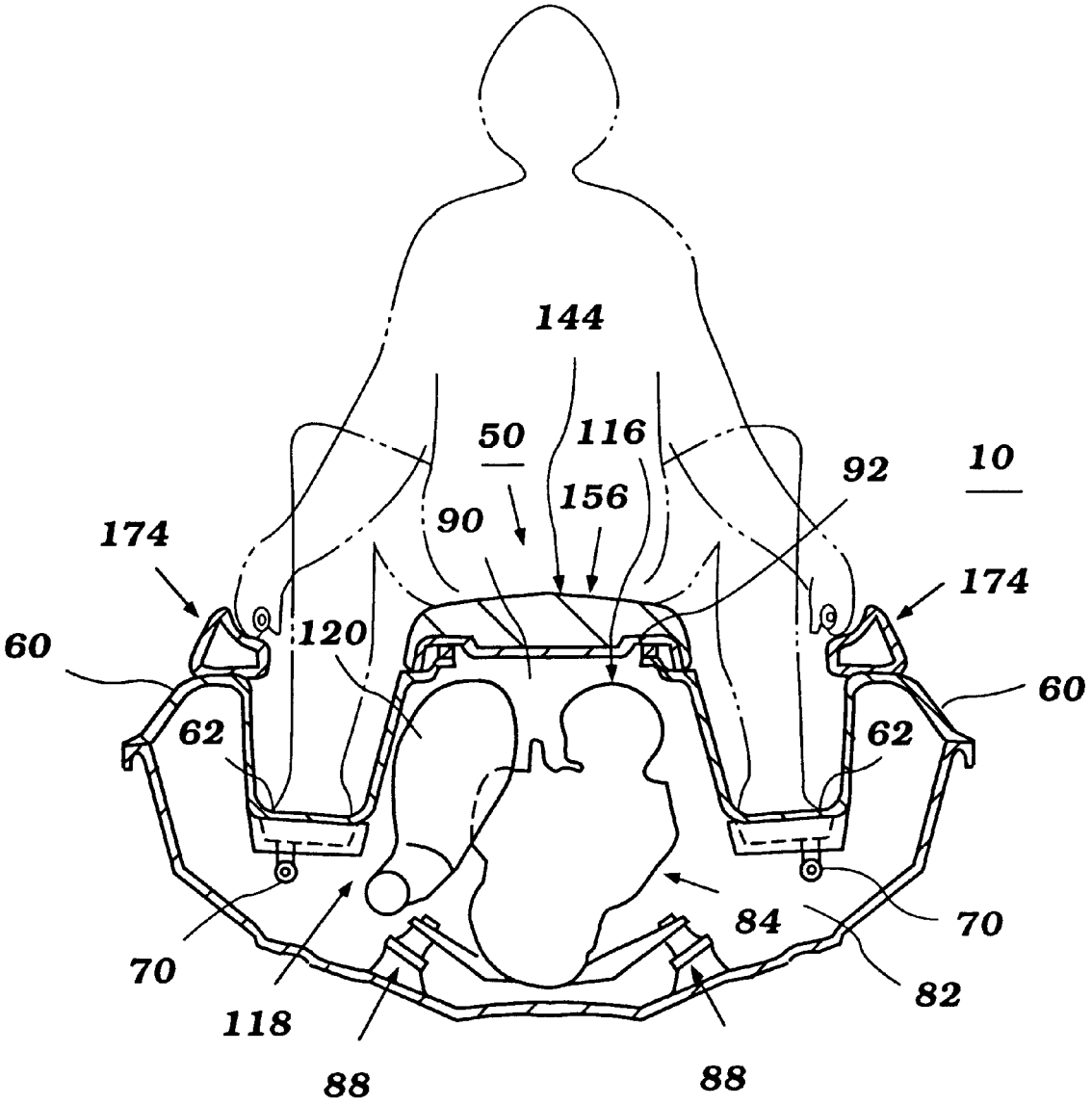
FIG. 7 is a cross-sectional view of the watercraft taken along line 7—7 of FIG. 2, and illustrates a passenger in phantom.

With reference to FIGS. 4 and 7, the hull 12 defines an engine compartment 82 in which an engine 84 is housed. A bulkhead 85 closes the aft end of the engine compartment 82, and is positioned to extend in the transverse direction (i.e., generally normal to the longitudinal direction) between the sides of the watercraft, beneath front edge of the rear seat section 54.

In the illustrated embodiment, the engine 84 is mounted in the center of the main body of the watercraft 10. The engine 84 preferably is an in-line, three-cylinder, two-cycle crankcase compression engine; however, other types of engines also can be used to power the watercraft. For instance, engines with other numbers of cylinders, with other cylinder arrangements and which operate on other operating principles (e.g., four-stroke) can be used for this purpose.

The engine 84 desirably is oriented within the hull 12 to locate a crankshaft 86 of the engine 62 along a longitudinal axis of the main body. The engine 84 is mounted above the bottom of the watercraft through damper members or mounts 88 in a known manner.

As seen in FIGS. 4 and 5, an access or maintenance opening 90 is located on an upper surface of the pedestal 56 under the front seat section 52. The access opening 90 opens into the engine compartment 82 formed within the hull 12. The front seat section 52 normally covers and seals closed the access opening 90. Located under the front seat is a water seal 92 which prevents water from entering the access opening 90. When the front seat section 52 is removed, the engine compartment 82 is accessible through the access opening 90.

An air duct or ventilation pipe 94 for guiding air into the engine chamber 82 is provided in a forward part of the engine chamber. In the illustrated embodiment, the air duct 94 is located in front of the access opening 90. The air duct 94 communicates with the atmosphere through a space or opening 96 between the pedestal 50 and the front seat section 52 near the control mast 22. A corresponding air duct can be located behind the engine 84.

A jet propulsion unit, indicated generally by reference numeral 98, is provided in a propulsion chamber or tunnel 100, formed on the underside of the lower hull 14, behind the bulkhead 85. This jet propulsion unit 98 includes an impeller shaft 102 to which an impeller 104 is fixed. The impeller shaft 102 is positioned in the forward/rear directions and extends through an intake duct 106 that has a water inlet port 108 positioned on a flat section of the keel of the hull bottom. An outlet nozzle 110 of the propulsion unit 98 is positioned at an open rear end of the tunnel 100. A front end of the impeller shaft 102 and the crankshaft 86 of the engine 84 are coupled through a coupling 112 to transfer power from the crankshaft 86 to the impeller shaft 102. The propulsion unit 98 generates the propulsive force by applying pressure to water drawn up from the water inlet port 108 by means of the rotation of the impeller 104, and forcing the pressurized water through the outlet nozzle 110 in a manner well known to those skilled in the art.

A nozzle deflector or steering nozzle 114 is connected to the outlet nozzle 110 of the propulsion unit 98. The steering nozzle 114 desirably moves left and right and possibly up and down via a known gimbal mechanism. The steering nozzle 114 is connected to a steering mechanism and trim mechanism (not shown), whereby the steering and trim angles can be changed by the operation of the steering handle and associated trim controls.

Figure 6:
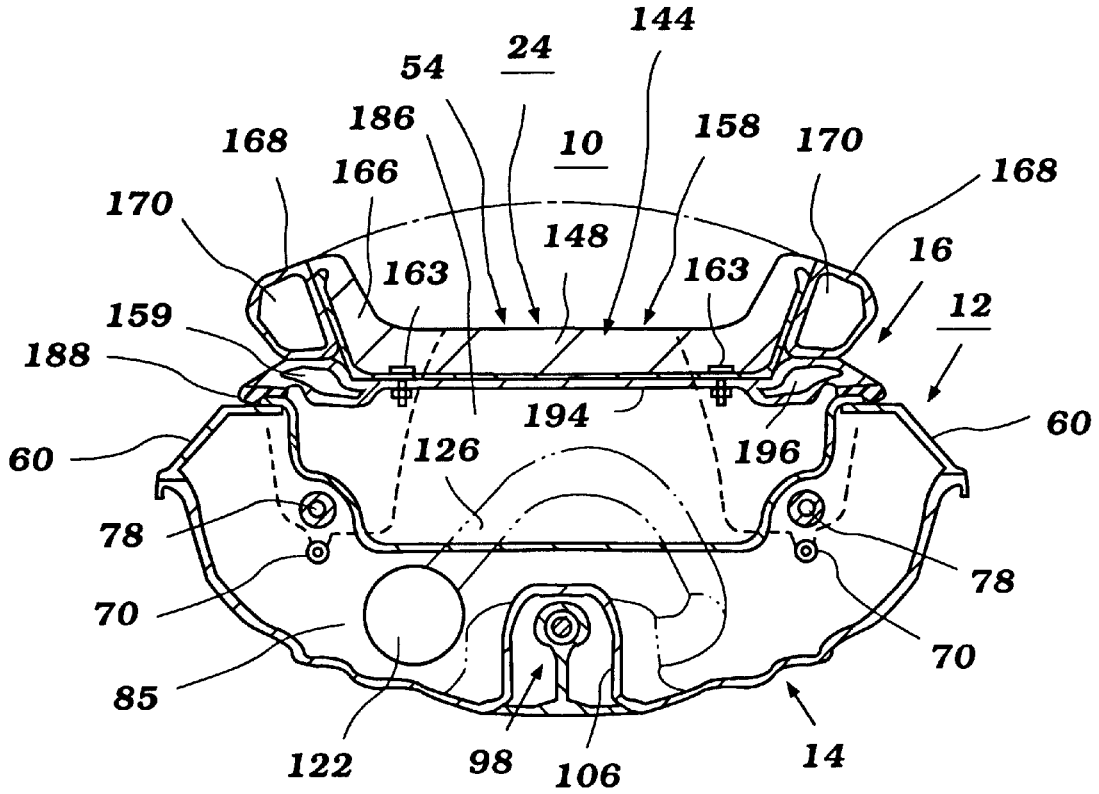
FIG. 6 is a cross-sectional view of the watercraft taken along line 6—6 of FIG. 2.

As further illustrated by FIGS. 4, 5, and 6, an air intake or induction system 116 (FIG. 5) is provided on one side of the engine 84. On the other side of the engine 84 the exhaust system 118 is provided. In the exhaust system 118, an exhaust pipe 120 extends from the front side of the engine 84 and bends to the rear direction. A downstream end of the exhaust pipe 120 is connected through a front end of a water lock or trap 122 via an exhaust connection pipe 124. The water lock 122 is provided on one side of the propulsion chamber 100, whereby the water lock 122 inhibits a reverse flow of water toward the engine 84. In the rear end of the water lock 122, a through-hull exhaust pipe 124 is connected. This exhaust pipe 124 extends upwardly and across the hull 12 and over the pump chamber 100, and is connected to the pump chamber 100 to exhaust into the chamber 100 at this location.

The seat assembly 50 of the present invention includes the elongated front seat section 52 and a wider rear seat section 54. In the illustrated embodiment, the rear seat section 54 is about twice as wide as the front seat section 52. The front section 52 is configured such that at least one rider, and preferably two or more riders, can straddle the seat with their feet positioned in the foot wells 58 that extend along side the front seat section 52. The rear seat section 54 is sized to accommodate at least one rider in a seated fashion with the rider's legs positioned forward of the rear seat section 55 in the foot wells 58. The rear seat section 54 has a sufficient size to allow the rider to shift his or her positions on the seat so as to assume a comfortable position when looking forward or backward (i.e., behind the watercraft). Thus, in the illustrated embodiment, the seat assembly 50 defines three rider positions A, B, C; two A, B along the front seat section 52 and one C on the rear seat section 54, as best understood from FIGS. 4 and 10.

The seat pedestal 56 supports these sections 52, 54 of the seat assembly 50. For this purpose, as best understood from FIG. 5, the seat pedestal 56 has a corresponding shape to the seat sections 42, 54, including a narrow fore section 128 formed between two longitudinally extending side walls 130, and a wider aft section. The aft section is formed by an upper flat surface 132 that extends between the bulwarks 60, just forward of the rear deck 66. End walls 134 extend transversely (i.e., in a direction generally normal to the longitudinal direction) between the side walls 130 of the pedestal 56 and inner walls of the bulwarks 60, along the front edges of the upper flat section 132, to close the aft end of the foot wells 58.

Figure 10:
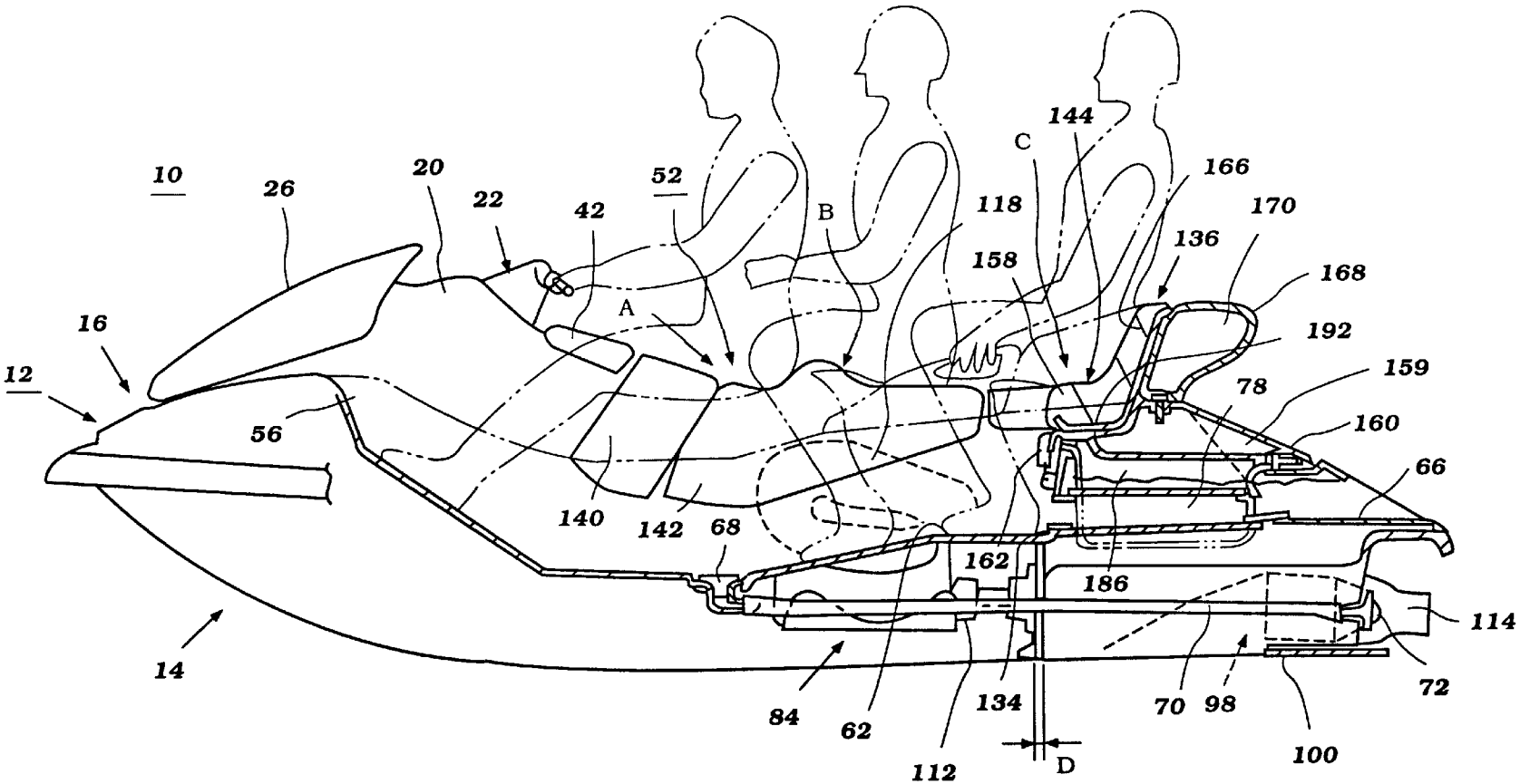
FIG. 10 is a partial sectional side view of the watercraft of FIG. 1, showing relative passenger positions in phantom.

As best understood from FIGS. 2 and 10, the end walls 134 are positioned below and behind a front surface 135 of the rear seat section 54 by a distance D (FIG. 2). The spaces formed at the rear ends of the foot wells 58, generally depicted as D in FIG. 2, allow the rider's heels to be placed slightly behind the front edge of the rear seat section 54 to provide stability, balance and a comfortable seating position for the rider in the third seating position C. And as illustrated in FIG. 10, this space D is positioned above the bulkhead 81 located in the hull below to provide additional structural support.

The seat sections 52, 54 desirably are padded and cover the entire upper surface of the seat pedestal 56. This arrangement produces a comfortable seating area for the operator and passengers in the watercraft 10.

As seen in FIGS. 1, 7, 8 and 10, the seat assembly 50 desirably includes at least one handle positioned next to the rear seat section 54. The handle is positioned at a location that assists the rider in shifting his or her position on the rear seat section 54. The seat assembly 50 can also include several handles for this purpose, as described below.

Figure 8:
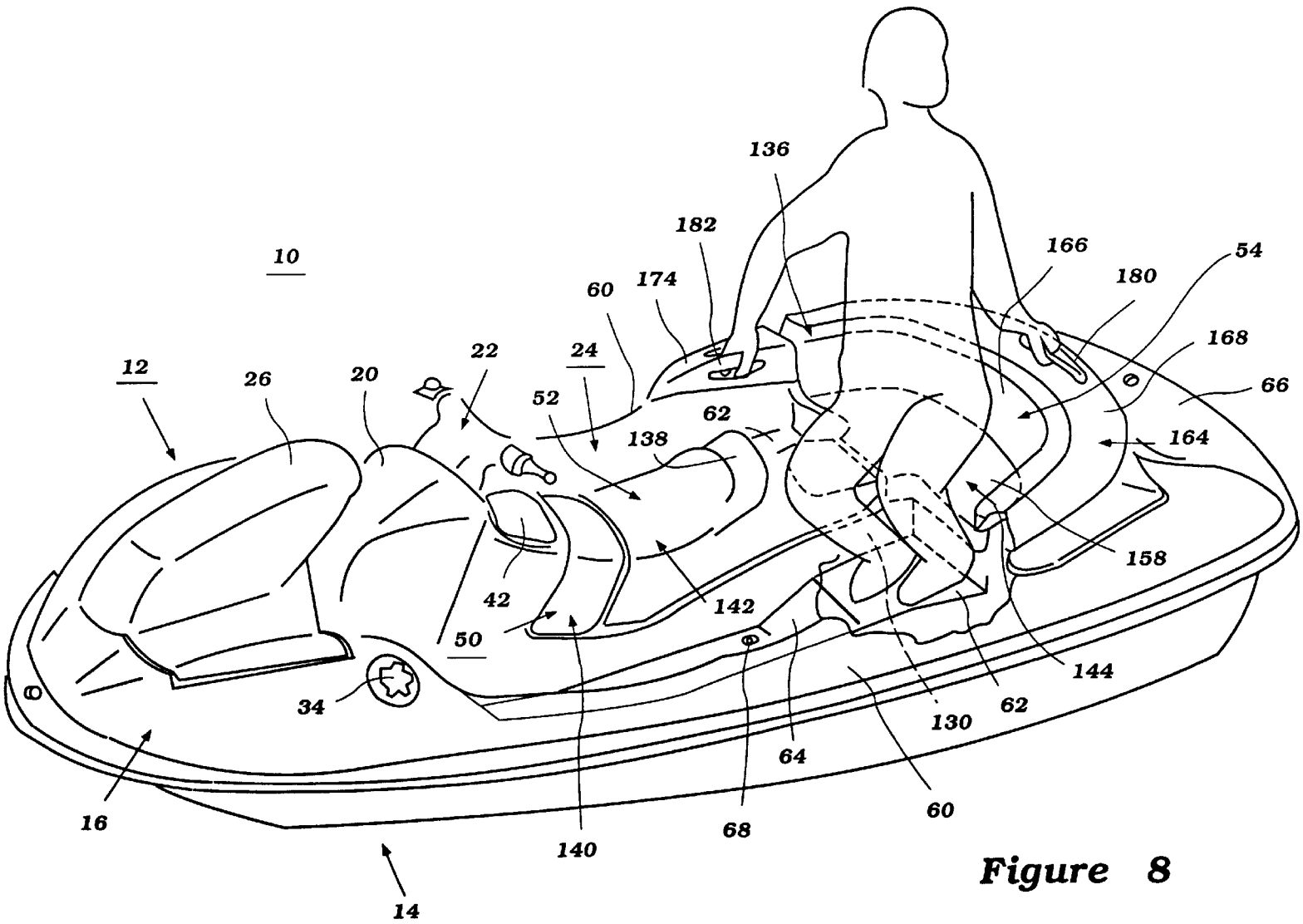
FIG. 8 is a partial sectional, perspective view of the watercraft of FIG. 1 and illustrates a passenger seated on the seating assembly in one possible position.

The seat assembly 50 also can include a backrest, generally designated by reference numeral 136, for the rider seated on the rear seat section 54. The backrest 136 desirably extends along the sides of the rear seat section 54, in addition to directly behind the rear seat section 54 in order to support the rider's back when shifted on the rear seat section to look behind the watercraft, as seen in FIG. 8.

The seat assembly 50 can additionally include at least another backrest 138 positioned along the front seat section 52. For instance, an operator's backrest 138 can be located directly behind the position of the operator on the front seat section 52.

In the illustrated embodiment, the front and rear section 52, 54 of the seat assembly are formed by three seat members: a front seat member 140, a middle seat member 142, and a rear seat member 144. It is understood, however, that the seat assembly 50 can be formed by more or less pieces. For example, the front and rear sections can be formed as a single component, or the rear section and a substantial part of the front section can be formed as a single component. The present modular arrangement, however, better facilitates removal of individual seat components in order to gain access to the space beneath the particular component, as described below.

Each seat member has the same general construction, as understood from FIG. 4. A rigid base 146 is sized to cooperate with a corresponding section of the seat pedestal 56. The base 146 supports a cushion 148. The cushion 148 can have a unitary structure (e.g., a foam insert) or can have a more complicated structure, such as that disclosed in U.S. Pat. No. 5,833,320 and in U.S. patent application Ser. No. 08/843,785, filed Apr. 21, 1997, both of which are assigned to the assignee hereof, and which are hereby incorporated by reference. A skin or cover 150 overlays the cushion 148 to help secure it to the base 146, as well as to generally isolate the cushion 148 from the elements (e.g., water, sun, etc.). For this purpose, the cover 150 desirably is a layer of material that is water-resistant. The cover 150 also can be semi-smooth or slightly roughened to inhibit the riders from unintentionally moving on the seat. For instance, in one mode, the exterior surfaces of the seat members are formed by a first skin, forming an upper seat surface on which the rider sits, and a second skin, forming a side surface against which the rider's inner thighs and legs contact. The first and second skins preferably are sewn together or are bonded to each other by an adhesive or other means well known to those skilled in the art. The first skin has a roughened exterior, possibly formed by delicate, transversely extending crimps or ridges to prevent slippage. This embodiment serves to hold further the riders at their desired location on the seat, while preventing excessive chafing and discomfort of unprotected, exposed skin (e.g., thighs and legs of the riders) due to the upper roughened surface of the seat members.

The front seat member 140 has a shorter length than the middle seat member 142 and is shaped to form a transition between the seat pedestal 56 and the control mast 22 at the front end of the seat assembly 50. For this purpose, the front seat member 140 angles upward from the middle seat member 142 and extends to a point just behind the small storage compartment 44 on the control mast 22. In this position, the front seat member 140 forms a portion of the first rider position A on the seat assembly 50. In the illustrated embodiment, the front seat member 140 is mounted onto the upper deck 16 beneath the control handles and the front section of the pedestal 56.

The middle seat member 142 is removably attached to the narrow fore section 128 of the seat pedestal 56 by conventional seat latches. The middle section 142 desirably has a sufficient length to completely cover the access opening 90 into the engine compartment 82 that is formed on the upper surface of the seat pedestal 56. And as seen in FIG. 4, the middle seat member 142 preferably has a sufficient length to define the second rider position B directly behind the first rider position A on the seat assembly 50.

In the illustrated embodiment, the middle seat member 142 includes the operator's backrest 138 formed between the first and second rider positions A, B on the seat assembly 50. The backrest 138 is defined by a raised section on the middle seat member 142. In one mode, this section is defined within the shape of the inner cushion; however, it is understood that other inner support elements can be used as well. As seen in FIG. 4, the backrest 138 desirably has a sloped front surface 152 and a sloped back surface 154 with the upper ends of the surfaces separated. The backrest 138 also extends transversely across the middle seat member 142, preferably from side to side.

Each of the sloped sections 152, 154 smoothly rises from the adjacent upper surface of the middle seat section 142, and has a sufficient height to inhibit sliding of the riders on the seat. For instance, the sloped surface 152 next to the front rider position A has a sufficient height (e.g., at least about an inch) to inhibit sliding of the operator on the seat in the rearward direction. The sloped shape 152 also can have a sufficient height to provide some support for the rider's lower back when seated in the first rider position A and facing forward. Likewise, the sloped surface 154 next to the second rider position B has a sufficient height (e.g., at least about an inch) to inhibit sliding of the rider on the seat in the forward direction. The sloped shape 154 can also have a sufficient height to provide some support for the rider's lower back when seated in the second rider position B and facing backward.

The sloping surfaces 152, 154 desirably are spaced apart from each other along a longitudinal axis of the middle seat member 142. The spacing desirably is sufficiently large to permit a front facing operator to rest against the front slope 152 of the backrest 138, and a rear facing passenger to simultaneously rest against the rear slope 154 of the backrest 138. In an exemplary embodiment, this distance is at least about two inches. And as seen in FIGS. 1 and 4, the upper surface of the backrest 138 is rounded and smoothly blends with the front and rear sloping surfaces 152, 154 of the backrest 138.

The rear seat member 144 includes a narrow fore portion 156 and a wider rear portion 158. The fore portion 156 has a width, measured transversely (i.e., generally normal to the longitudinal axis of the seat assembly 50), that generally matches that at the rear end of the middle seat member 142. The rear portion 158 can be significantly wider that the fore portion 156, and the maximum width of rear portion 158 desirably is substantially equal to the width between the bulwarks 60 (i.e., the combined width of the seat pedestal fore section 128 and the foot wells 58 on the sides of the pedestal 56).

In the illustrated embodiment, the rear portion 158 of the rear seat member 144 has a generally semi-circular shape. Thus, the aft edge of the seat extends longitudinally in a rearward direction, curves to extend transversely, and curves again to extend longitudinally in a forward direction. The shape of the rear seat member 144 desirably matches the shape of the aft section 132 of the seat pedestal 56.

The rear seat member 144 is mounted to the aft section 132 of the pedestal. In the illustrated embodiment, the aft section 132 of the pedestal includes a hinged member 159 to allow the rear seat member 144 to be raised, desirably from a side within the watercraft 10. That is, hinges 160 attach the rear side of the hinged member 159 to the aft end of the seat pedestal 56, while one or more latches 162 releasably secure the front side of the hinged member 159 to the pedestal 56. In particular, as seen in FIG. 10, a latch or lock 162 is positioned below the front edge 135 of the seat on the end wall 134 on either side of the fore section 128 of the seat pedestal 56. In this manner, a person within the rider area can raise the hinged member 159 and the rear seat member 144 to gain access to the space beneath the seat, as described below. And the particular location of the latches 160 allows a person seated rearward on the front seat section 52 in the second riding position B to raise the rear seat member 144. This preferably can be done without removing either the middle or front seat members 140, 142.

As best seen in FIG. 6, fasteners 163 secure the base 146 of the rear seat member 144 to the hinged member 159 of the pedestal 56. The fasteners desirably can be accessed from the lower side of the hinged member 159 so as to ease detachment of the rear seat member 144 for repair or replacement.

The backrest 136 about the rear seat section 144 is formed at least in part by a support 164 and part of the rear seat member 144. As seen in FIG. 4, the rear seat member 144 includes an upstanding part 166 that extends about a rear side of the rear seat member 144 and rises to a height above the rear portion 158 of the rear seat member 144. In the illustrated embodiment, the upstanding part 166 of the rear seat member 144 thus extends in a generally semi-circular pattern, running along the longitudinal sides of the rear seat member 144 and extending transversely along the back side of the rear seat member 144. While in the illustrated embodiment, the upstanding part 166 and the rear portion 158 of the rear seat member 144 form a single component, it is understood that these portions of the rear seat member 144 can be formed as separate pieces.

A rear section 168 of the support 164 has a generally complementary shape to the upstanding part 166 of the rear seat member 144. An inner surface of the support rear section 168 generally matches the shape of the exterior surface of the rear seat member upstanding part 166 and mates flush therewith. The rear section 168 of the support 164 generally surrounds the perimeter of the rear seat portion 144 and extends forwardly on either side of the rear seat member 144 to a point near the front edge of the rear seat section 54.

The support rear section 168 preferably has a generally hollow inner section 170 formed by a shell of suitable material, such as, for example, molded plastic. Fasteners 172 secure the support rear section 168 to the upstanding part 166 of the rear seat member base 146. And as best seen in FIG. 4, the base 146 of the rear seat member 144 also extends beyond the upstanding part section 166 and supports the lower surface of the support rear section 168.

The support 164 also includes a pair of side sections 174, as best seen in FIGS. 1 and 2, attached to upper surfaces 176 of the bulwarks 60, just forward of the rear seat member 144. The support side sections 174 are mounted to the hull and are positioned generally forward of the longitudinally extending sides of the support rear section 168. In the illustrated embodiment, fasteners secure the support side sections 174 onto upper surfaces 176 of the bulwarks 60; however, the support side sections 174 can be molded or otherwise formed with the bulwarks 60, as described below.

Each side section 174 extends forward of one side of the support rear section 168. The rear end of each side section 174 generally matches the combined width of the support rear section 168 and the inner upstanding part 166 of the rear seat member 144. And the height of the side sections 174 generally match the difference in height between the upper surface of the support rear section 168 and the upper surfaces 176 of the bulwarks 60. The side sections 174 taper in width and height along their lengths, and smoothly blend into the upper surface 176 of the corresponding bulwark 60, as best seen in FIG. 1.

The upstanding part 166 of the rear seat member 144 includes a chamfer 178 also to form a smooth transition between the upstanding part 166 and the support rear section 168. As seen in FIG. 1, the chamfer 178 desirably extends about the entire inner side of the upstanding part 166 of the rear seat member 144, thereby providing a slightly beveled edge between the inner upper edge of the upstanding part 166 of the rear seat member 144 and the support 164.

In the illustrated embodiment, the seat assembly 50 includes three handles 180, 182 spaced around the backrest 136. The handles 180, 182 of the seat assembly 50 are formed in the side sections 174 of the support 164 and in the support rear section 168. The rear handle 180 is located near the mid-section of the support 164, on the backside of the backrest 136. As illustrated in FIG. 8 (rider in phantom), this handle 180 can be used to facilitate a rider to swing his or her body around to a position to monitor activities taking place off the stem of the watercraft 10.

As best seen in FIG. 4, the handle 180 is built into the support 164, preferably by forming an aperture in the support rear section 168. The aperture preferably extends entirely through the support rear section 168 to form a hand grip on the back side of the support 164. The handle 180 desirably is centrally located relative to the rear deck 66.

Each side section 174 of the support 164 includes an aperture that extends diagonally through the upper and inner sides of the support side section 174 to form the corresponding side handle 182. The aperture is sized to form a hand grip such that the passenger can place their hands into the aperture and grasp the support side section 174. The handles 182 on the support side sections 174 can be used by a rider seated on the rear seat member to maintain his or her balance (as seen in FIGS. 7 and 10), as well as used by the rider when shifting his or her position on the rear seat (as seen in FIG. 8).

Figure 9:
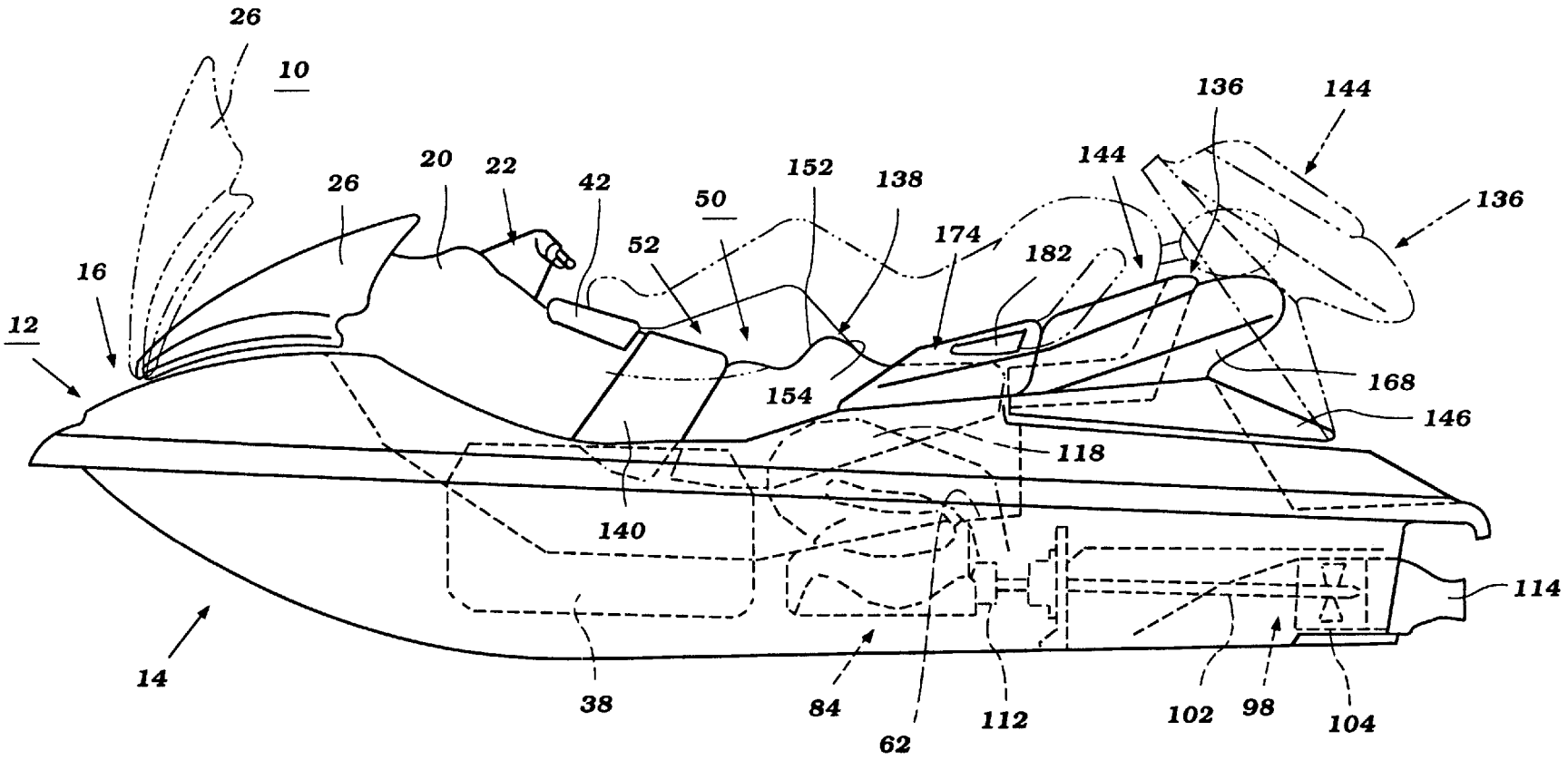
FIG. 9 is a side elevational view of the watercraft of FIG. 1, and illustrates in phantom a rear seat member of the seat assembly and the hatch of a hatch assembly in elevated positions.

As illustrated in FIG. 9, the rear seat member 144 can be raised to expose the space beneath the rear section of the seat. In the illustrated embodiment, an opening 184 is formed in the top surface 132 of the pedestal 56 below the rear seat member 144. A storage container 186 is removably provided in the opening 184. The storage container 186 desirably has a flange (not shown) formed along the exterior of its upper edge. The flange rests atop the pedestal top surface 132 to support the storage container 186 within the opening 184. A seal 188 desirably encircles the upper opening 184 to the storage container 186 and operates between the flange and the lower surface of the rear seat member base 146. The storage container 186 depends into the hull 12 and occupies the space formed between the side walls of the hull 12, above the tunnel 100 and drain passages 78.

FIG. 4 best illustrates an insulation member, generally designated by reference numeral 190, which is arranged on the lower side of the rear seat member base 146 and cooperates with the opening to the storage container 186. When the rear seat member 144 is closed (i.e., sits flush against the upper surface 132 of the seat pedestal 56), the insulator member 190 fits snugly into the upper end of the storage container 186 to insulate this end of the storage container 186. Although not illustrated, the other sides of the storage container 186 can also be insulated for better storage of cold or hot items.

In the illustrated embodiment, the insulator member 190 is integrally formed with the hinged member 159 of the pedestal 56. The hinged member 159 is formed with an upper wall 192, which supports the base 146 of the rear seat member 144, and a lower wall 194, which is shaped to protrude into the upper opening of the storage container 186. A space 196 is formed between the upper and lower walls 192, 194. This space 196 may be filled with air or other suitable insulation. As seen in FIG. 6, this space 196 desirably runs about the periphery of the storage container upper opening so as to insulate the edges of the container 186 while the seat cushion 148 acts as an insulator above the storage container 186. The space 196 can also extend partially or entirely beneath the seat member 144 to provide further insulation.

A rider can access the hull 12 in the area above the tunnel 100 (i.e., the chamber of the hull in which the jet pump unit 98 is located) by raising the rear seat member 144, and then subsequently removing the storage container 186 from the opening 184. While the rider is performing this operation, the above-described construction of the seat assembly 50 allows the rider to sit in the second rider position B on the middle seat member 142, facing in a rearward direction. Because the rider is seated on the middle seat member 142 while performing this operation, watercraft balance is maintained during this operation.

As seen in FIGS. 8–10, the above described seat assembly 50 thus provides multiple distinct seating positions (e.g., A, B, C) that allow the passengers to face forward or backward on the seat assembly 50 in a comfortable manner. The larger size of the rear seat section 54 also permits the passenger to easily swing around and view the activities behind the watercraft, such as view a water skier, during travel (e.g., when the watercraft is up on plane). The positions of the handles 180, 182 assist the rider in shifting his or her position on the seat 54, as well as improve the rider's stability and comfort when facing backward. And as seen in FIG. 9, a rider can also easily raise the rear seat 54 to gain access into the storage compartment 186 beneath the rear seat 54, while remaining centrally positioned on the watercraft 10.

FIG. 9 also illustrates that a rider can comfortable recline on the seat assembly 50 when the watercraft 10 is at rest. The upstanding part 166 of the rear seat member 144 provides a cushion for the rider's head against the backrest support 164. The curve and position of the operator's backrest 138 also allows an average size adult to comfortable recline. That is, the distance between the backrests 136, 138 is such that a head, torso and buttock of an average-size rider can comfortable lie on this section of the seat assembly 50.

Figure 11:
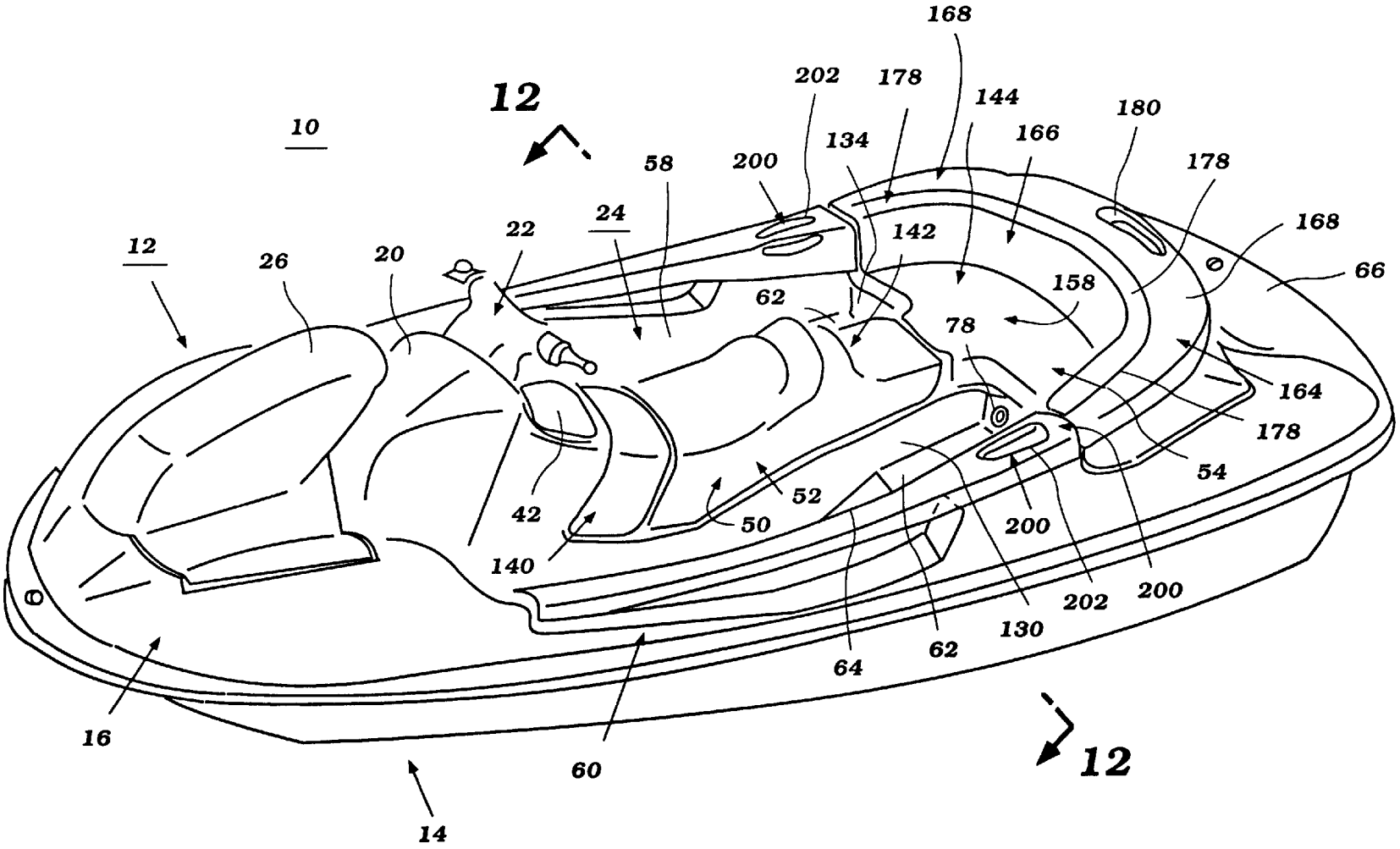
FIG. 11 is a perspective view of a watercraft including a seating assembly configured in accordance with another preferred embodiment of the present invention.
Figure 12:
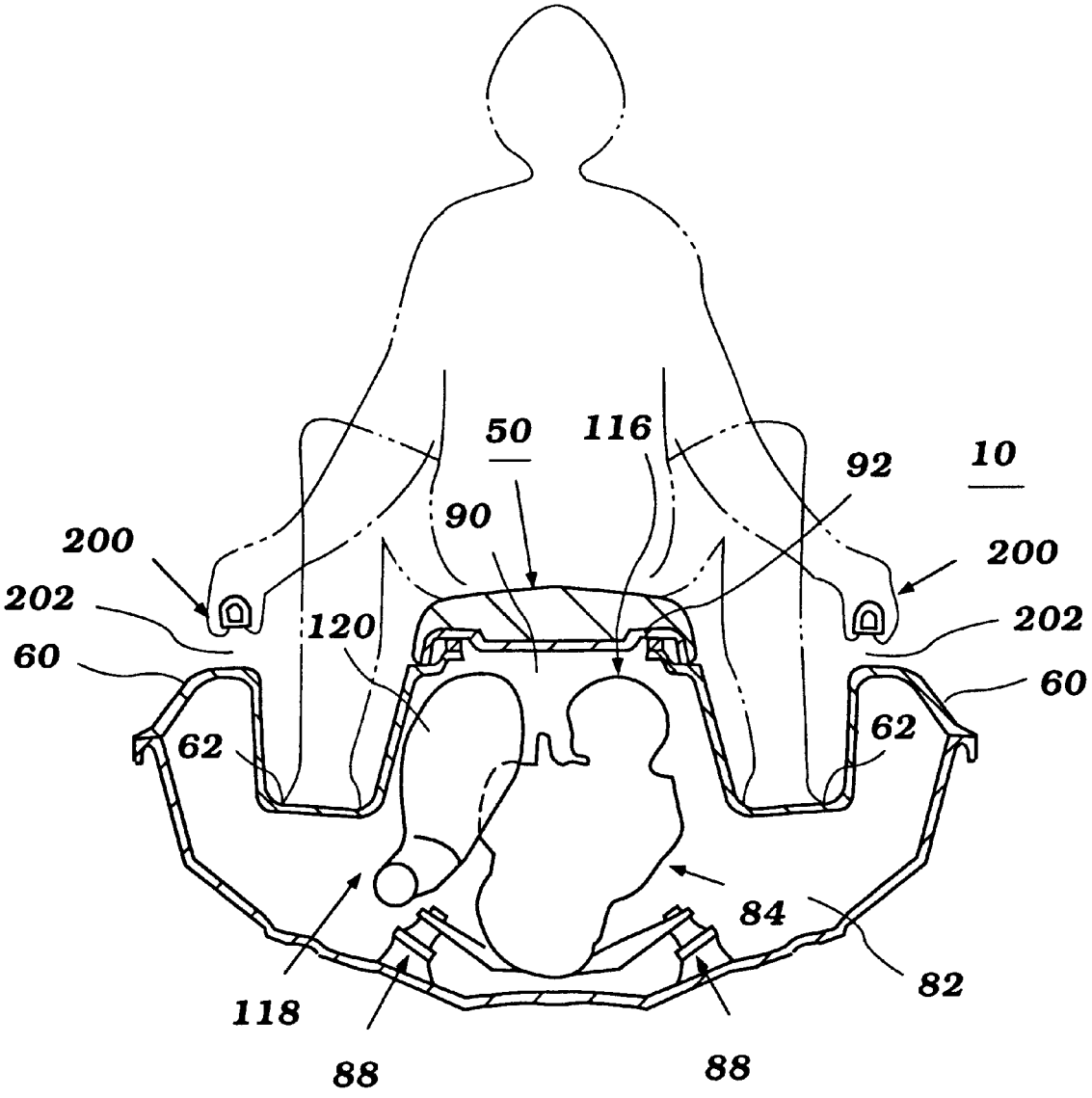
FIG. 12 is a cross-sectional view of the watercraft taken along line 12—12 of FIG. 11, and illustrates relative positions of the passengers in phantom.

FIGS. 11 and 12 illustrate another embodiment of the present invention using the bulwark 60 as a gripping surface or handle along with the grip 182 described above. In this embodiment, the bulwark 60 extends generally along the rider's area 24 and is designed to provide a gripping area along the longitudinal length of the watercraft 10. The bulwark includes a grip 200 and through holes 202 created by removing an area of the upper deck 16. A rider can wrap his or her hands around the grip 200 since the bulwark 60 is provided with the through hole area 202. The grip 200 along the bulwark 60 provides a grasping area for any watercraft rider along the length of the seat assembly 50.

Figure 13:
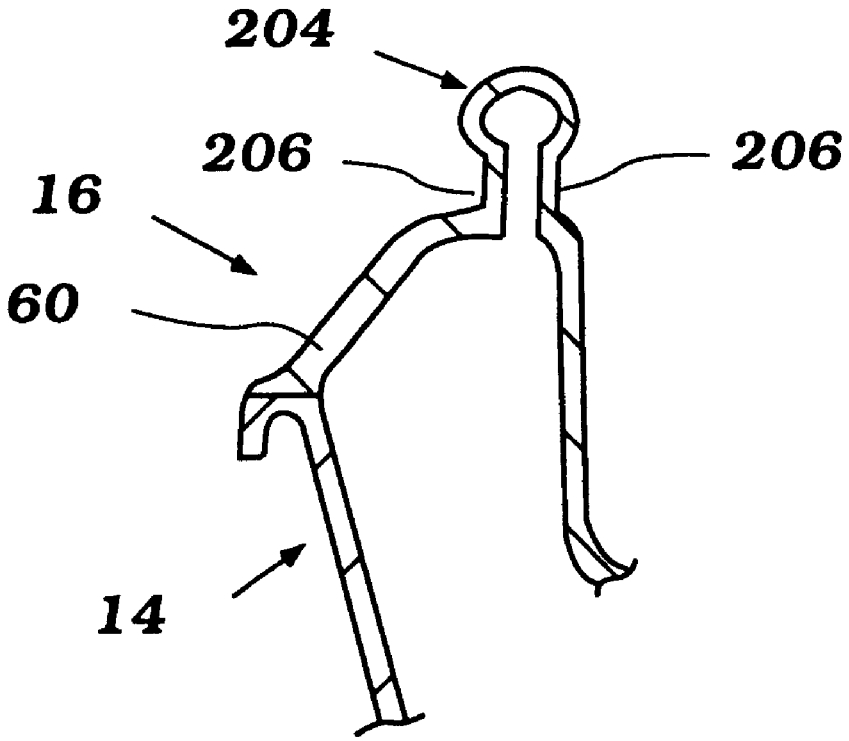
FIG. 13 is an enlarged sectional view of an additional handle portion formed on a bulwark of the watercraft of FIG. 11.

FIG. 13 illustrates an additional gripping embodiment that does not employ an aperture arrangement in the bulwark 60. The bulwark 60 rather includes a grip 204 extending above the bulwark and two recessed portions 206 located below the grip on both sides. The grip 204 and recesses 206 generally extend along the length of the bulwark 60 in the rider's area 24.

Figure 14:
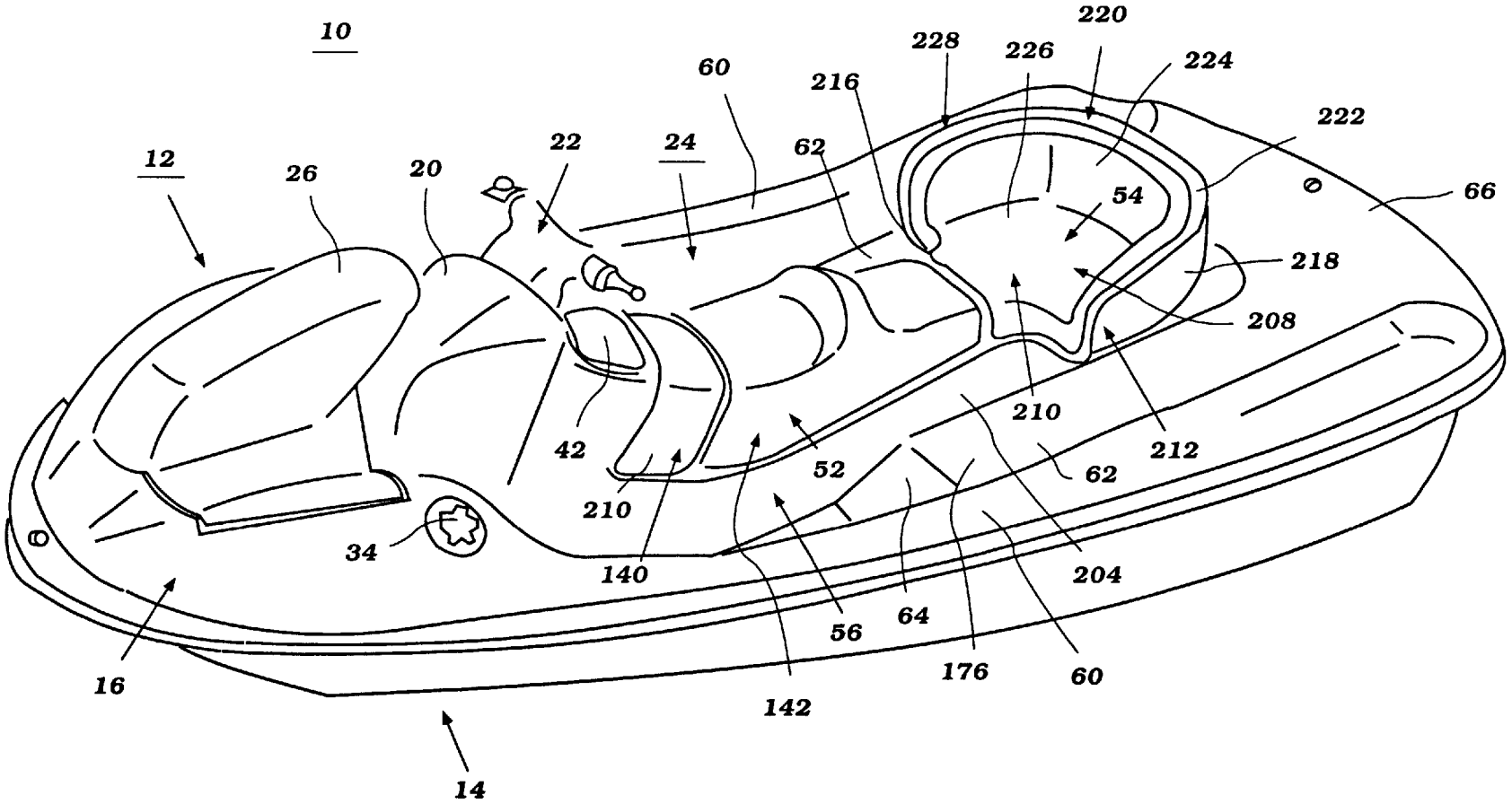
FIG. 14 is a perspective view of a watercraft including a seat assembly configured in accordance with an additional embodiment of the present invention.
Figure 15:
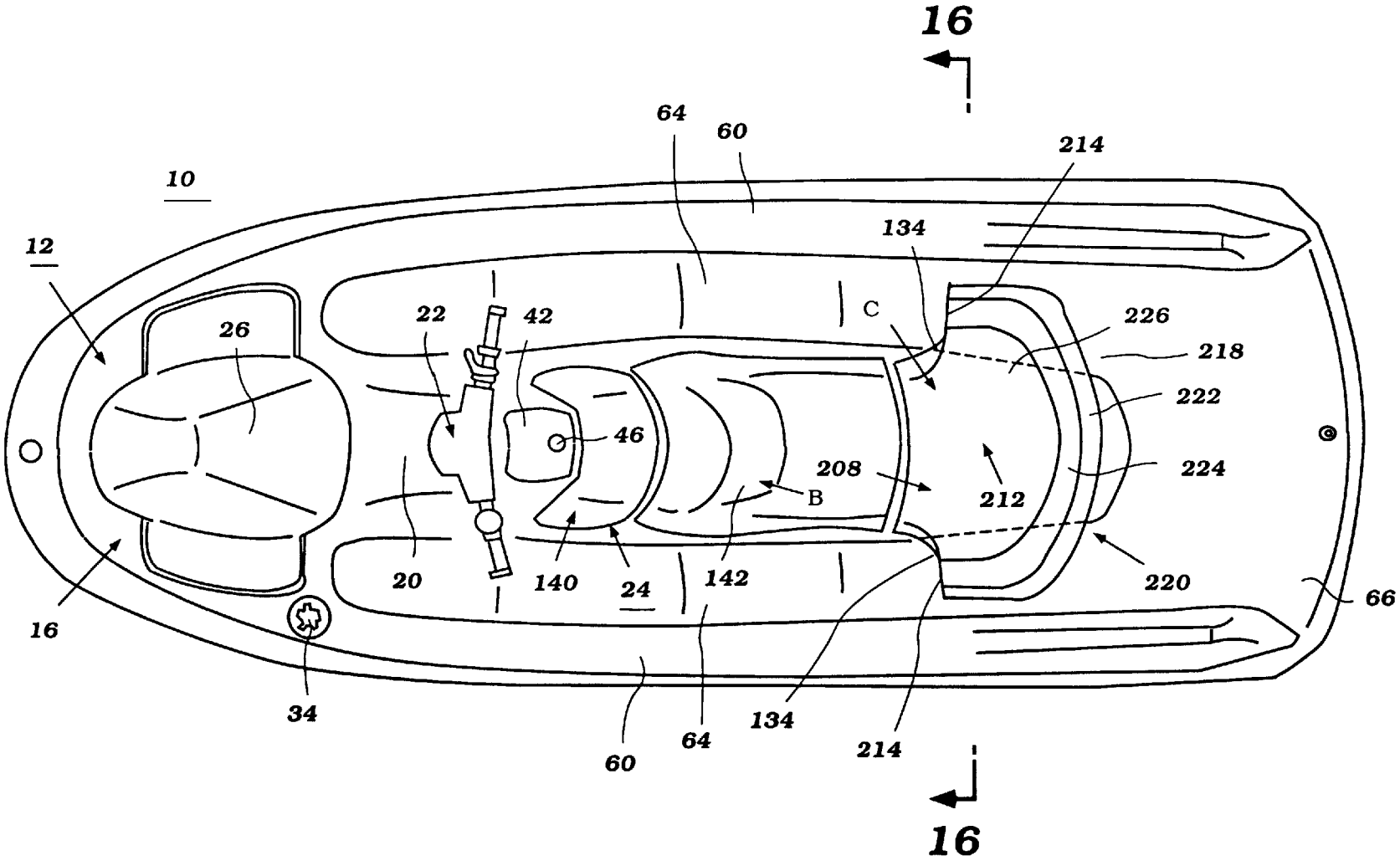
FIG. 15 is a top plan view of the watercraft of FIG. 14.
Figure 16:
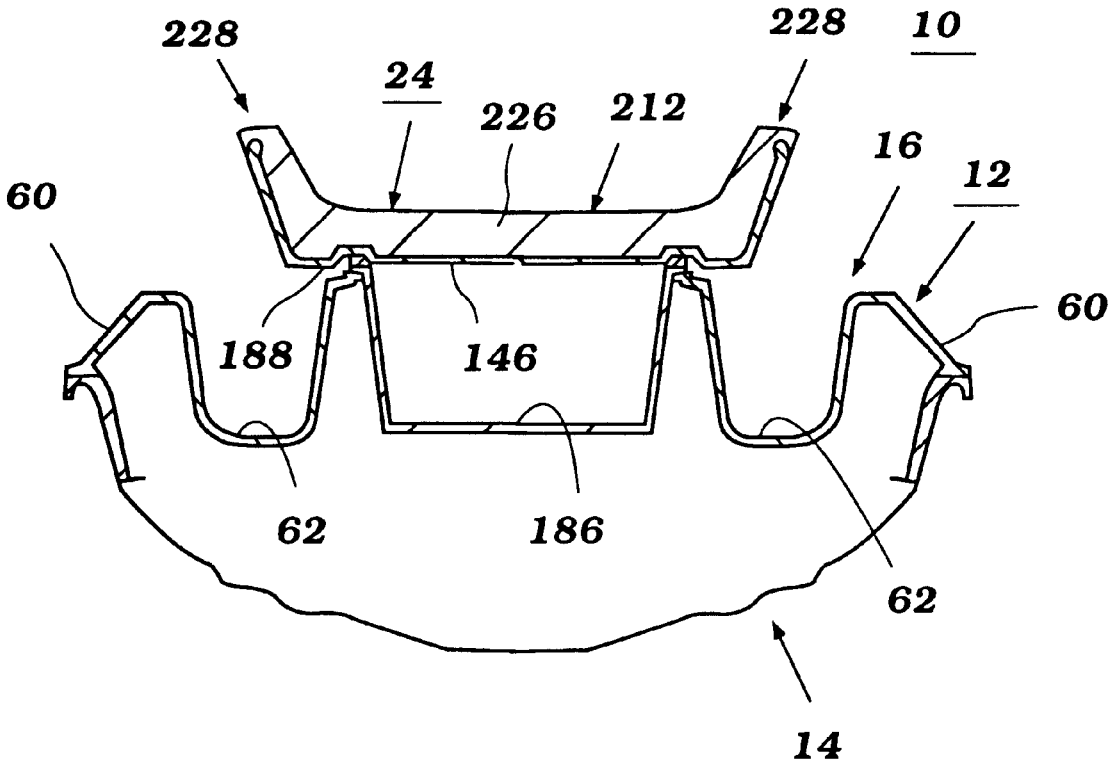
FIG. 16 is a cross-sectional view of the watercraft taken along line 16—16 of FIG. 15.

FIGS. 14–16 illustrate another embodiment of the present invention providing a rear seat member 208 of a generally cup shape. The seat assembly 50 comprises a rear seat member 208 along the longitudinally extending pedestal 56, that includes a narrow front portion 210 which spreads out into a larger curved rear seat area 212 of a width greater than the front portion 210. The side surface 214 of the pedestal 56 near the front portion 210 of the rear seat 208 continues extending longitudinally towards the stem of the watercraft 10. The rear seat 208 further includes front edge 216 of the seat located above the pedestal 56 and extending transversely from the pedestal 56.

A rear seat support 218 surrounds the rear seat element 208 generally around the perimeter of the rear seat 208. The support 218 includes a back rest element 220, and an outer support element 222 generally extending around the back rest 220 of the rear seat 208. The rear seat 208 includes a back rest portion 224 and rear seat portion 226. The back rest 220 rises from the rear seat 226 to a height above the seat and the back rest 224 surrounds the seat transversely and longitudinally. The back rest element 220 forms a generally semi-circular cup shape around the rear seat 208. Preferably, the rear seat element 208 comprises the rear seat portion 226 and the back rest portion 224 as one unit.

The side back rest edges 228 of the rear seat support 218 extend laterally forward around the outside edges of the wide section 212 of the rear seat 226 to the front edge 216 of the seat. These edges 228 preferably extend to a point at least halfway of the longitudinal axis of the rear seat 226 in order to provide a comfortable and effective hand grip for a passenger. Desirably, the lateral extending sections 148 of the support 218 are generally curved and contoured around the rear seat 226 at the transition from the transverse section 230 of the support 218.

In the illustrated embodiment, the rear seat member 208 can be removed while the front seat section 52 remains mounted. The rear seat member 208 can be fastened to the upper deck 16 by various mechanisms well known by those skilled in the art, such as hinges, latches, snap fasteners, and/or straps, among others. Preferably, the rear seat member 208 will incorporate at least one hinge-type or other flexible fastener to allow a rider to move the rear seat member 208 without requiring detachment of this element, thereby allowing the rider to access a storage compartment 186 without completely removing the rear seat member 208 from the watercraft. In the illustrated embodiment, the top of the storage box 186 is covered by the bottom of the rear seat element 208 in a water sealing manner.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A watercraft comprising a hull having a lower hull portion and an upper deck portion, and a propulsion system carried by the hull to propel the watercraft, the upper deck portion including a central elongated seat assembly having a front seat section and a rear seat section that are positioned along a longitudinal axis, the rear seat section having a generally planar upper surface and having a width, as measured in a direction generally normal to the longitudinal axis, that is at least about twice as large as a width of the front seat section, and at least one handle positioned next to the rear seat section.

2. The watercraft of claim 1 additionally comprising a second handle positioned next to the rear seat section, said first and second handles being arranged about the rear seat section to permit a rider to easily grip at least one of the handles when seated on the rear seat section.

3. The watercraft of claim 1 additionally comprising a backrest including a rear support section rising to a height above the rear seat section and extending transversely generally between sides of the rear seat section.

4. The watercraft of claim 3, wherein the handle is located on the backrest.

5. The watercraft of claim 1, wherein the rear seat section is pivotally coupled to the upper deck.

6. The watercraft of claim 1, wherein the upper surface of the rear seat section and an upper surface of the front seat section are generally co-planar.

7. The watercraft of claim 6, wherein the front seat section and the rear seat section are formed independently of each other.

8. The watercraft of claim 6 additionally comprising a gap formed between the front seat section and the rear seat section.

9. The watercraft of claim 1, wherein the upper surface of the rear seat section is semicircular.

10. The watercraft of claim 1 additionally comprising bulwarks along each side of the hull, the rear seat section extending between the bulwarks.

11. The watercraft of claim 1 additionally comprising a backrest having lateral ends which wrap around lateral edges of the rear seat section and extend longitudinally towards a bow of the hull.

12. The watercraft of claim 11, wherein the lateral ends of the backrest extends to a point at least halfway of the longitudinal axis of the rear seat section.

13. The watercraft of claim 1 additionally comprising a cup-shaped backrest.

14. The watercraft of claim 1 additionally comprising a backrest extending along longitudinal sides of the rear seat section.

15. The watercraft of claim 1, the front seat section and the rear seat section being configured so as to form a substantially continuous and generally planar connection therebetween.

16. The watercraft of claim 1, wherein the rear seat section comprises at least one forward-facing edge extending between the front seat section and at least one lateral edge of the rear seat section, the forward edge being semi-circular.

17. The watercraft of claim 16, wherein the at least one forward-facing edge includes a locus positioned forward of the forward edge.

18. The watercraft of claim 16, wherein the at least one forward-facing edge is configured to allow a rider to sit on a rearward portion of the front seat section facing backwards, such that at least one of the rider's legs is accommodated by the at least one forward-facing edge.

19. The watercraft of claim 1 additionally comprising means for accommodating a knee of a rearwardly facing rider sitting on the front seat section.

20. A watercraft comprising a hull having a lower hull portion and an upper deck portion, and a propulsion system carried by the hull to propel the watercraft, the upper deck portion including a central elongated seat assembly having a front seat section and a rear seat section that are positioned along a longitudinal axis, the rear seat section having a width, as measured in a direction generally normal to the longitudinal axis, that is greater than a width of the front seat section, at least a portion of the rear seat section being movably attached to the upper deck portion of the hull, and a storage compartment located beneath at least a portion of the rear seat member.

21. The watercraft of claim 20, wherein the backrest additionally comprises a pair of support side sections that are connected to the watercraft hull.

22. The watercraft of claim 20, wherein the upper deck include a pair of bulwarks, and each bulwark includes a hand grip formed in an upper section of the bulwark.

23. The watercraft of claim 20, additionally comprising a backrest having a rear support section with a generally curved shape.

24. The watercraft of claim 20 additionally comprising a backrest having a rear support section with sides, wherein the sides of the rear support section extend along at least half of the length of the corresponding side of the rear seat section, as measured along the longitudinal axis.

25. The watercraft of claim 21, wherein at least one of the side support sections includes a hand grip.

26. The watercraft of claim 20 additionally comprising a backrest having a rear support section and a second support located forward of the rear support section and arranged to support at least a portion of a back of a rider who is operating the watercraft.

27. The watercraft of claim 26, wherein second support includes an inclined rear side surface.

28. The watercraft of claim 20, additionally comprising a backrest having a rear support section including an open recess forming a hand grip.

29. The watercraft of claim 20, wherein the upper deck includes a pair of foot wells extending along both sides of the seat assembly, and each of the foot wells extends beneath a portion of the rear seat section.

30. A watercraft comprising a hull having a lower hull portion and an upper deck portion, and a propulsion system carried by the hull to propel the watercraft, the upper deck portion including a central elongated seat assembly having a front seat section and a rear seat section that are positioned about a longitudinal axis, and a backrest including a rear support section rising to a height above the rear seat section and extending transversely generally between sides of the rear seat section, and a pair of support side sections that are connected to the watercraft hull, the rear seat section having a width, as measured in a direction generally normal to the longitudinal axis, that is greater than a width of the front seat section, and the rear support section extending forwardly along the sides of the rear seat member, the hull including a pair of bulwarks, each of the side support sections aligning with one of the bulwarks on a corresponding side of the watercraft.

31. The watercraft of claim 30, wherein a foot area is formed between the seat assembly and the bulwark, forward of the rear seat section.

32. The watercraft of claim 31 additionally comprising a water drainage passage communicating with the foot area.

33. The watercraft of claim 30, wherein each of the side support sections is inclined downwardly at a point where it connects to the corresponding bulwark.

34. The watercraft of claim 33, wherein the side support section smoothly transitions into an upper surface of the corresponding bulwark.

* * * * *